US005794183A

United States Patent [19]

Müller et al.

[11] Patent Number: 5,794,183

[45] Date of Patent: Aug. 11, 1998

[54] METHOD OF PREPARING DATA, IN PARTICULAR ENCODED VOICE SIGNAL PARAMETERS

[75] Inventors: Jörg-Martin Müller, Schwaikheim; Bertram Wächter, Allmersbach/Tal, both of Germany

[73] Assignee: Ant Nachrichtentechnik GmbH, Backnang, Germany

[21] Appl. No.: 530,204

[22] PCT Filed: Apr. 20, 1994

[86] PCT No.: PCT/DE94/00433

§ 371 Date: Sep. 25, 1995

§ 102(e) Date: Sep. 25, 1995

[87] PCT Pub. No.: WO94/27284

PCT Pub. Date: Nov. 24, 1994

[30] Foreign Application Priority Data

May 7, 1993 [DE] Germany ..... 43 15 319.4

[51] Int. Cl.[6] ..... G10L 3/02

[52] U.S. Cl. ..... 704/222; 704/229; 704/230

[58] Field of Search ..... 395/2.31, 2.39, 395/2.29, 2.17, 2.38; 704/222, 230, 220, 208, 229

[56] References Cited

U.S. PATENT DOCUMENTS

| | | | |
|---|---|---|---|
| 4,817,157 | 3/1989 | Gerson | 395/2.39 |
| 4,969,192 | 11/1990 | Chen et al. | 395/2.31 |
| 5,091,945 | 2/1992 | Kleijn | 395/2.38 |
| 5,233,660 | 8/1993 | Chen | 395/2.17 |
| 5,265,167 | 11/1993 | Akamine et al. | 395/2.29 |

FOREIGN PATENT DOCUMENTS

| | | | |
|---|---|---|---|
| 0294020 | 7/1988 | European Pat. Off. | G10L 9/14 |
| 0504627 | 9/1992 | European Pat. Off. | G01L 9/14 |
| 0266620 | 5/1988 | Germany | G10L 9/14 |

OTHER PUBLICATIONS

ICASSP–88. Copperi, Rule based speech analysis and application of CELP coding; p. 143–146 vol. 1, Apr. 1988.

1991 IEEE International Symposiium on Circuits and Systems. Akamine et al., "Efficient Excitation model fro low bit rate speech coding", p. 586–589 vol. 1, Jun. 1991.

*Primary Examiner*—Allen R. MacDonald
*Assistant Examiner*—Richemond Dorvil
*Attorney, Agent, or Firm*—Michael J. Striker

[57] ABSTRACT

Method of preparing data, in particular voice signal parameters for transmission at a low bit rate, identical signal parameters are combined interval by interval in quantized form; for further bit reduction, bits are suppressed from the total number of bits of at least two intervals, the bit difference to be suppressed being formed on the basis of the total number of unreduced bits with respect to the next-higher power of two; and the procedure supplies a better voice quality than in the case of changing the number of quantization stages by multiples of 2.

6 Claims, 2 Drawing Sheets

METHOD OF PREPARING DATA, IN PARTICULAR ENCODED VOICE SIGNAL PARAMETERS

BACKGROUND OF THE INVENTION

The invention relates to a method of preparing data, in particular encoded voice signal parameters for transmission purposes.

In the encoding and decoding of voice signals, in particular for mobile radio applications, the voice signal is sampled and sub-divided into intervals (time intervals). For each interval, predicted values are formed for different types of signal parameters. Such signal parameters are, for example, short-term parameters for characterizing the formant structure (resonances of the voicebox) and long-term parameters for characterizing the pitch structure (level of tone) of the voice signal (ANT Nachrichtentechnische Berichte [ANT Communication Reports], issue Nov. 5, 1988, pages 93–105). In voice encoding by means of "Analysis by Synthesis", the model and excitation parameters are quantized, encoded and transmitted to the receiver. For further reducing the bit rate, vector quantization is used (see above; DE/EP 0 266 620 T1; EP 504 627 A2; EP 294 020 A2).

SUMMARY OF THE INVENTION

The object of the present invention is to develop a method of the type mentioned at the beginning such that, with further reducing of the bit rate, a satisfactory reconstruction of the output data is possible. This object is achieved by the steps of claim 1. The further claims illustrate advantageous refinements.

The method according to the invention is distinguished in particular by its robustness with respect to transmission errors. The method according to the invention makes it possible to construct voice codes of which the voice quality is better than in the case of voice codes with reduction of the quantization stages by multiples of 2. Since transmission errors generally occur several at once, the complexity is reduced along with no deterioration in error correction.

An exemplary embodiment of the invention is now explained in more detail with reference to the drawings.

DESCRIPTION OF PREFERRED EMBODIMENTS

Figure 1:
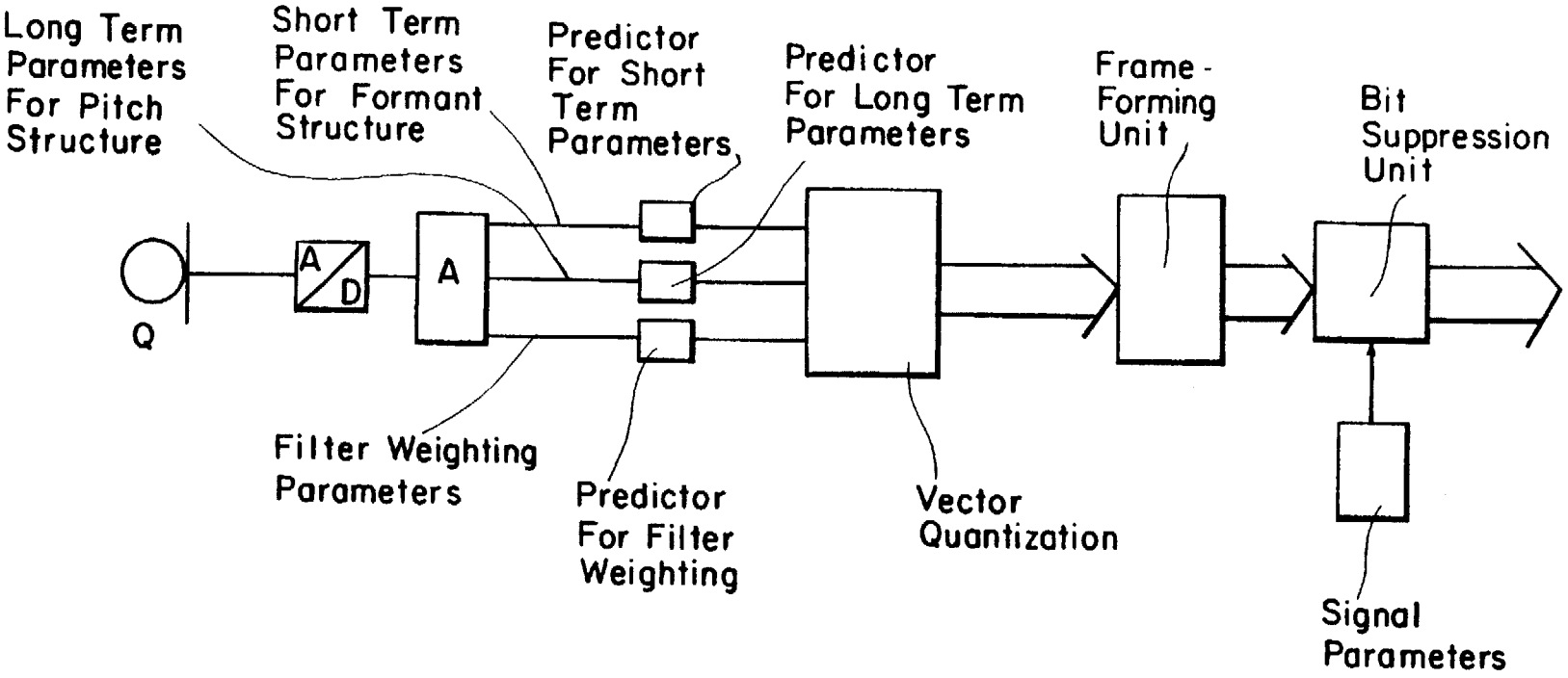
FIG. 1 shows a block diagram of a voice coder which operates by the method of the invention.

As FIG. 1 shows, voice signals of a voice signal source Q are sampled by means of an A/D converter and analyzed with regard to identical voice signal parameters in an analysis unit A. The analysis unit supplies in each case a set of mutually identical voice signal parameters, for example a set of short-term parameters KP for the formant structure (excitation parameters), a set of long-term parameters LP for the pitch structure and a set of filter weighting parameters FP. With these sets of parameters, predicted values are respectively obtained in predictors PRK, PRL, PRF in a conventional way, for example according to EP 364 647, and are subjected to vector quantization VQ. In a frame-forming unit RA, the quantized signal parameters are combined, to be precise for example such that a frame of a frame period of, for example, 20 msec. comprises 4 frame intervals of a period of in each case 5 msec. In each of these frame intervals there are accommodated identical signal parameters. From at least two of these frame intervals (in the following the handling of in each case two frame intervals is described, but more than two frame intervals can of course also be handled together), bits are then suppressed by means of a bit suppression unit BÜ. According to the invention, the bit suppression is not carried out individually for each frame interval but for the total number of bits from at least two types of combined identical frame intervals, ie. for example for the total number of bits of the short-term and long-term parameters in a frame of a period of 20 msec. In the bit suppression it is ensured that the quantization stages per frame interval are equally distributed. The number n of the bits to be suppressed is advantageously distributed over the frame intervals in accordance with the relationship m $\sqrt{2\ g\text{-}n}$, where m indicates the number of identical signal parameters and g indicates the total number of original bits. The bit difference from the total number g of unreduced bits with respect to the next-higher power of two is consequently suppressed.

For the bit suppression, preferably those bits which correspond to the quantization stages which are statistically least probable are selected. This requirement can be satisfied, for example, by less probable quantization stages being stored beforehand in a memory SP, which controls the bit suppression unit BÜ. Since the probability of the quantization stages is generally conditional, ie. for a chosen signal parameter from one frame interval there are, in the next frame interval, signal parameters whose occurrence following the chosen signal parameter is more probable than the occurrence of others, the procedure according to FIG. 2 is followed in the selection of bit suppression, ie. in the structure represented all the bits whose fields are crossed are suppressed.

Figure 2:
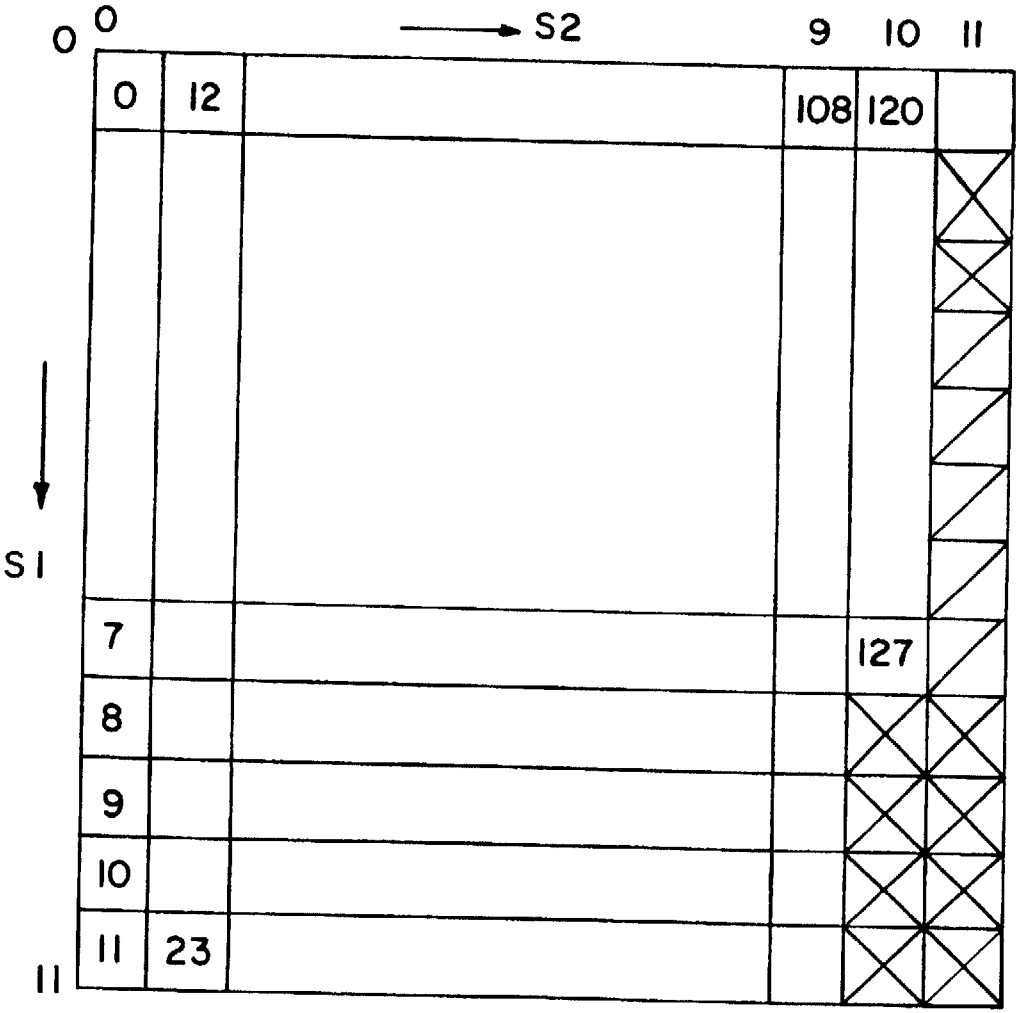
FIG. 2 shows the frame structure of two frame intervals for different types of signal parameters.

In FIG. 2 there is represented a structure of 12×12 vectors. The frame interval S1 has a quantization with 4 bits for amplitude values of the same type, likewise the frame interval S2. 7 bits result for the vector. The bit suppression then takes place in accordance with the following relationships:

for $S1 \leqq 7$ it holds that $0 \leqq S2 \leqq 10$ and for $S1 > 7$ it holds that $0 \leqq S2 \leqq 9$.

S1 and S2 indicate the vector components of the two frame intervals. For the example represented it holds that:

$$\text{Index}=S2\times 12+S1<127$$

The scheme represented in FIG. 2 can of course be transferred correspondingly to other structures, for example to another number of amplitude values to be quantized.

So far, the combination of identical signal parameters in frame intervals has been described. Identical signal parameters can of course also be combined in another way instead of in frame intervals. It just has to be ensured that they are identifiable as belonging together for further processing.

We claim:

1. A method of preparing data, in particular encoded voice signal parameters for transmission purposes, having the following steps:

output data of a voice signal source are analyzed with regard to identical signal parameters, Signal parameters out of digitized voice data of the voice signal source are generated, identical signal parameters are combined interval by interval in quantized form, the total number of bits for at least two types of combined signal parameters is reduced such that the quantization stages are approximately equally distributed over the individual intervals and that the bit difference from the total number of unreduced bits with respect to the next-higher power of two is suppressed.

2. The method as claimed in claim 1, wherein those bits which correspond to the statistically least probable quantization stages are suppressed.

3. The method as claimed in claim 1, wherein, with an original total number of g bits and a given bit reduction n, the resulting $2^{g-n}$ quantization stages are evenly distributed such that for each interval there are approximately m $\sqrt{2^{g-n}}$, quantization stages, where m in each case indicates the number of identical signal parameters.

4. The method as claimed in claim 1, wherein the data are arranged in a frame structure, respectively different types of signal parameters forming frame intervals.

5. The method as claimed in claim 4, wherein in each case two frame intervals with different types of signal parameters are combined and bit-reduced.

6. The method as claimed in claim 5, wherein, in a vector quantization of the voice signal parameters with 7 bits/vector and a structure of 8×12 vectors, the following relationships are chosen for the bit suppression:

for $S1 \leqq 7$ it holds that $0 \leqq S2 \leqq 10$ and for $S1 > 7$ it holds that $0 \leqq S2 \leqq 9$, S1 and S2 indicating the vector components of the two frame intervals.

* * * * *